US011703310B2

(12) United States Patent
Berg

(10) Patent No.: US 11,703,310 B2
(45) Date of Patent: Jul. 18, 2023

(54) PENETRATOR, USE OF A PENETRATOR, AND PROJECTILE

(71) Applicant: Rheinmetall Waffe Munition GmbH, Suedheide (DE)

(72) Inventor: Martin Berg, Suedheide (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 0 days.

(21) Appl. No.: 17/671,317

(22) Filed: Feb. 14, 2022

(65) Prior Publication Data

US 2022/0333907 A1 Oct. 20, 2022

Related U.S. Application Data

(63) Continuation of application No. PCT/EP2020/066881, filed on Jun. 18, 2020.

(30) Foreign Application Priority Data

Aug. 15, 2019 (DE) ..... 10 2019 121 984.1

(51) Int. Cl.
*F42B 12/06* (2006.01)
*F42B 12/62* (2006.01)

(52) U.S. Cl.
CPC ..... *F42B 12/06* (2013.01); *F42B 12/625* (2013.01)

(58) Field of Classification Search
CPC ..... F42B 12/06; F42B 12/625
USPC ..... 102/518
See application file for complete search history.

(56) References Cited

U.S. PATENT DOCUMENTS 4,301,737 A * 11/1981 Yuhash ..... F42B 12/06 102/493
5,069,138 A 12/1991 Ekbom
5,275,109 A 1/1994 Puckett
6,186,072 B1 * 2/2001 Hickerson, Jr. ..... F42B 12/204 102/517
6,408,762 B1 * 6/2002 Schmacker ..... F42B 25/00 102/382
6,659,013 B1 12/2003 Kellner
(Continued)

FOREIGN PATENT DOCUMENTS

DE 3207854 A1 8/1988
DE 3932952 A1 4/1991
(Continued)

OTHER PUBLICATIONS

International Search Report dated Oct. 5, 2020 in corresponding application PCT/EP2020/066881.

*Primary Examiner* — Samir Abdosh
(74) *Attorney, Agent, or Firm* — Muncy, Geissler, Olds & Lowe , P.C.

(57) ABSTRACT

A penetrator for a projectile with a tail assembly, wherein the penetrator includes at least one outer body that acts in a terminal ballistic manner for attacking an armored target, in particular a battle tank with reactive armor. The cross-section of the outer body perpendicular to a longitudinal axis of the outer body is a hollow cross-section. The hollow cross-section of the outer body has an area, and an area moment of inertia of the hollow cross-section is increased in comparison with a solid cross-section of at least equal area, so that the outer body has an increased bending stiffness on account of the increased area moment of inertia.

14 Claims, 6 Drawing Sheets

(56) References Cited

U.S. PATENT DOCUMENTS

| | | | | |
|---|---|---|---|---|
| 6,772,695 | B2 | 8/2004 | Kellner | |
| 7,150,235 | B1 * | 12/2006 | Mikhail | F42B 10/06 102/521 |
| 11,293,730 | B1 * | 4/2022 | Burke | F42B 12/16 |
| 11,353,302 | B1 * | 6/2022 | Steffner | F42B 14/04 |
| 2017/0307344 | A1 | 10/2017 | Connolly | |
| 2020/0173761 | A1 * | 6/2020 | Vabnick | F42B 12/06 |
| 2022/0341718 | A1 * | 10/2022 | Jones | F42B 12/78 |
| 2022/0412706 | A1 * | 12/2022 | Burke | F42B 12/74 |

FOREIGN PATENT DOCUMENTS

| | | | |
|---|---|---|---|
| DE | 4028409 | A1 | 3/1992 |
| DE | 68924336 | T2 | 3/1996 |
| DE | 19752102 | A1 | 6/1998 |
| DE | 19700349 | C1 | 8/1998 |
| DE | 19948710 | A1 | 4/2001 |

* cited by examiner

PENETRATOR, USE OF A PENETRATOR, AND PROJECTILE

This nonprovisional application is a continuation of International Application No. PCT/EP2020/066881, which was filed on Jun. 18, 2020, and which claims priority to German Patent Application No. 10 2019 121 984.1, which was filed in Germany on Aug. 15, 2019, and which are both herein incorporated by reference.

BACKGROUND OF THE INVENTION

Field of the Invention

The present invention relates to a penetrator for a projectile with a tail assembly. The penetrator includes at least one outer body, wherein the cross-section of the outer body perpendicular to a longitudinal axis of the outer body is a hollow cross-section. In addition, the invention relates to a use of such a penetrator for attacking an armored target with a reactive armor module. Furthermore, the invention relates to a projectile with a sabot and a tail assembly, wherein the projectile includes such a penetrator.

Description of the Background Art

A penetrator is a sub-caliber kinetic energy projectile that achieves its effects through kinetic energy. Such projectiles are usually fired at a target in direct fire by tanks or artillery with large-caliber guns.

Modern target systems (protection systems) of Russian tanks consist of a heavy main target and reactive armor modules (ERA—Explosive Reactive Armor). These reactive armor modules generally consist of multiple steel plates set at an angle, which are accelerated with the aid of energetic intermediate layers (explosive film) upon impact of the penetrator. In this process, the plates of the armor module interact with the penetrator.

Previous penetrators often are designed in one piece as solid penetrators, and have a homogeneous body. Such penetrators are known from DE 199 48 710 A1 and DE 40 28 409 A1, for example, and which are incorporated herein by reference.

These known penetrators are optimized against semi-infinite inert targets. Semi-infinite targets in this context are targets that extend "infinitely" in one direction from a perpendicular surface. In practice, these are armor plates of sufficient width and depth that there is no influence on the impacting penetrator by the free surface. The optimization consists in that solid penetrators are longer and narrower and the length-to-diameter ratio is higher than previously. However, this is associated with a reduction in the bending stiffness, so that these penetrators are bent upon impact with an armor module and are deflected from their flight path by the armor modules. Penetration of the main target is no longer possible.

In addition, penetrators are known that have an outer body that has a hollow cross-section perpendicular to a longitudinal axis of the outer body. Such penetrators are known from, for example, the document DE 197 00 349 C1, which corresponds to US 2004/0129163, and have a core that has no terminal ballistic effect and serves as an expansion medium for the outer body. These penetrators serve to achieve a high fragmentation effect. By this means, a breach can be shot in a building wall or in a barrier, for example, or soft targets in a lightly armored or unarmored vehicle can be attacked effectively. Such penetrators have only limited effectiveness against armor of modern battle tanks, however.

Attempts have already been made in the past to stiffen known penetrators, for example by the application of stabilizing strips to the exterior of the projectiles, as is evident from DE 39 32 952 A1, which is incorporated herein by reference. For this purpose, tail assemblies were provided over nearly the entire projectile length, although this has proven to be disadvantageous with regard to the aerodynamic characteristics of the projectile.

A problem in the development of penetrators is the conflict of goals between the highest possible kinetic energy, which acts on as small a surface as possible, at the target, and at the same time high bending stiffness so that deflection by armor modules can be avoided. In general, if the bending stiffness of a penetrator is to be increased, the diameter of the penetrator must increase. However, this leads to a higher weight and thus a reduction in the maximum speed of the penetrator, which has the result on account of ($K.E.=\frac{1}{2}*m*v^2$) that the kinetic energy at impact becomes smaller. If the speed of a penetrator is reduced, however, then the effectiveness of the penetrator in the main target also drops at the same time.

It is a disadvantage of the known penetrators that they are not suitable for piercing an armored target with reactive armor modules.

SUMMARY OF THE INVENTION

It is therefore an object of the present invention to provide a penetrator that has improved penetrating power even against armored targets having armor with reactive armor modules.

According to an exemplary embodiment of the invention, a penetrator for a projectile with a tail assembly is provided, wherein the penetrator includes at least one outer body that acts in a terminal ballistic manner for attacking an armored target, in particular a tank with reactive armor. The cross-section of the outer body perpendicular to a longitudinal axis of the outer body is a hollow cross-section.

This achieves the result that the outer body of the penetrator has an increased bending stiffness as compared with a production penetrator, such as the applicant's DM53 or DM63, with a solid outer body of the same outer body cross-sectional area, without it being necessary to increase the weight of the penetrator as compared with the production penetrator.

"Attacking an armored target" within the meaning of the invention provides for a destruction of a main target.

"Acting in a terminal ballistic manner" within the meaning of the invention means that a ballistic effect suitable for destroying the target is achieved by an element acting in a terminal ballistic manner.

The area moment of inertia of the outer body of a penetrator according to the invention is increased as compared to previous penetrators without increasing the weight of the penetrator in doing so and without reducing the kinetic energy that is introduced into the main target.

According to the invention, increasing the area moment of inertia while simultaneously keeping the same weight in the design of a penetrator achieves a solution for the above-described conflict of goals that makes it possible to create a penetrator that is both especially resistant to bending vis-à-vis pre-target structures and also is effective on the main target.

In addition, a use of such a penetrator, or an improved penetrator as described below, for attacking an armored target with a reactive armor module is created according to the invention.

Furthermore, a projectile with a sabot and a tail assembly is created according to the invention, wherein the projectile includes such a penetrator or an improved penetrator as described below.

Preferably, the hollow cross-section of the outer body can have an area A, and an area moment of inertia of the hollow cross-section is increased in comparison with a solid cross-section of at least equal area so that the outer body has an increased bending stiffness on account of the increased area moment of inertia.

In addition, provision can be made that an area moment of inertia of the penetrator is increased compared with a production penetrator by at least 10%, preferably at least 25%, further preferably 40%, in particular more than 60%, further in particular 90%, with the same weight or a reduced weight. Increasing the area moment of inertia also increases the bending stiffness.

In an advantageous improvement of the penetrator, the outer body can have an area moment of inertia of more than 20,000 $mm^4$, preferably more than 40,000 $mm^4$, further preferably more than 60,000 $mm^4$, in particular more than 80,000 $mm^4$, and a modulus of elasticity that greater than 300,000 $N/mm^2$.

This achieves the result that the bending stiffness of the outer body is high enough that the penetrator is sufficiently insensitive to bending with respect to an approaching reactive armor module of armor to pierce a main target.

In an advantageous improvement of the penetrator, provision can be made that the hollow cross-section extends over at least 70% of the length of the outer body.

This achieves the result that the weight of the penetrator is not increased compared with a production penetrator.

In an improvement of the penetrator, provision can be made that the penetrator has, arranged in the outer body, a core that acts in a terminal ballistic manner, wherein the core has a lower density than the outer body.

The ratio of the density of the outer body to the density of the core preferably is less than 2.7.

In order for the core and outer body to act together in a terminal ballistic manner, they are joined to one another in an interlocking and/or frictional and/or integral manner.

Provision can be made that the mass of the penetrator is below 7 kg, preferably less than 6 kg, and the mass of the penetrator can be adjusted through the mass of the core.

This achieves the result that the weight of the penetrator with an outer body can be adjusted through the selection of a specific core, and the outer body can be produced as a mass product.

In an improvement of the penetrator, provision can be made that the position of the center of gravity of the penetrator in relation its longitudinal axis can be adjusted through the mass and the position of the core.

Provision can be made that the bending stiffness of the outer body is increased by at least 25%, preferably 50%, further preferably by at least 75%, in particular by at least 90%, wherein the increase refers to existing production penetrators.

In addition, provision can be made that the hollow cross-section of the outer body is annular, trapezoidal, or polygonal in design.

The core can be made of a high-strength material, in particular a tungsten heavy metal sintered material or a high-strength steel.

The outer body can be manufactured from a tungsten heavy metal.

Tungsten heavy metals are defined in the ASTM B777-07 material standard, for example.

In an improvement of the penetrator, provision can be made that the outer body and the core are made such that they have no fragmentation effect or only a negligible fragmentation effect upon impact with a target.

In this way, a good piercing effect in the main target is achieved and a fragmentation at the pre-target structure is avoided.

Furthermore, provision can be made that the core has a modulus of elasticity of more than 70,000 $N/mm^2$, preferably of more than 170,000 $N/mm^2$, further preferably of more than 200,000 $N/mm^2$, in particular of more than 300,000 $N/mm^2$.

Moreover, the core can have an effect that makes the outer body more resistant to bending.

This achieves the result that the core likewise acts on the penetrator to make it more resistant to bending. Consequently, the bending stiffness of the penetrator is increased both by increasing the bending stiffness of the outer body and by forming a bending-resistant core.

The density of the core is preferably at least 7.80 $g/cm^3$.

The above values are merely recommended values for the relevant person skilled in the art, and the subject matter of the invention is not limited to these values.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
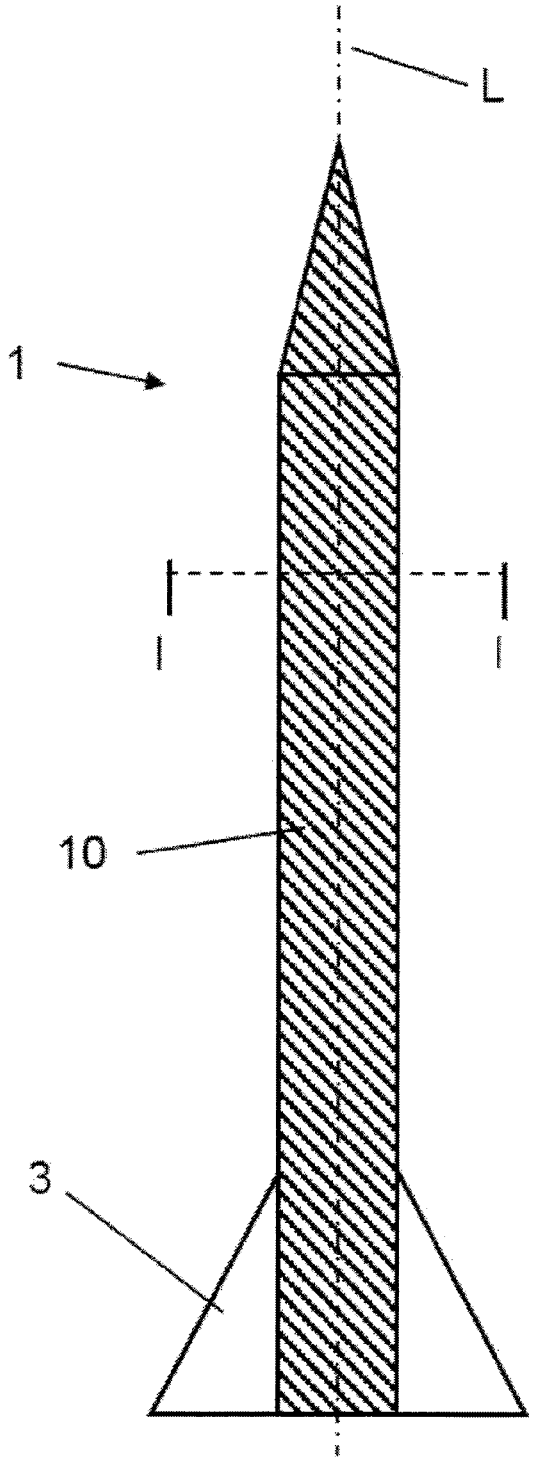
prior art Fig. 1
FIG. 1 shows a schematic sectional representation of a production penetrator according to the prior art.

FIG. 1 shows a schematic sectional representation of a production penetrator, which is to say of a penetrator 10, according to the prior art. The penetrator 10 is solid in design.

Figure 2:
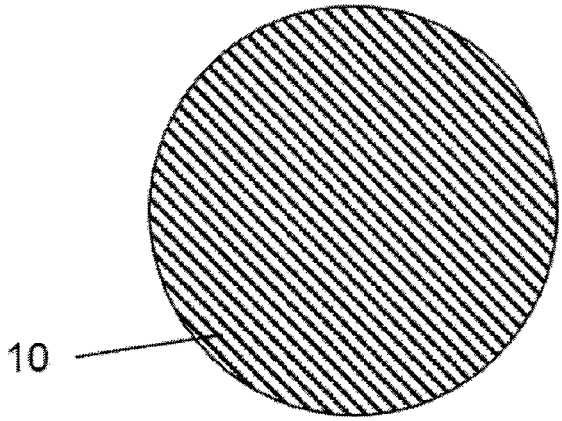
prior art Fig. 2
FIG. 2 shows a schematic sectional representation of the production penetrator according to FIG. 1 along the line I-I.

FIG. 2 shows a schematic sectional representation of the penetrator 10 according to FIG. 1 along the line I-I. As is evident from the sectional representation, the penetrator 10 has no cavities, but instead is designed as one solid piece.

Figure 3:
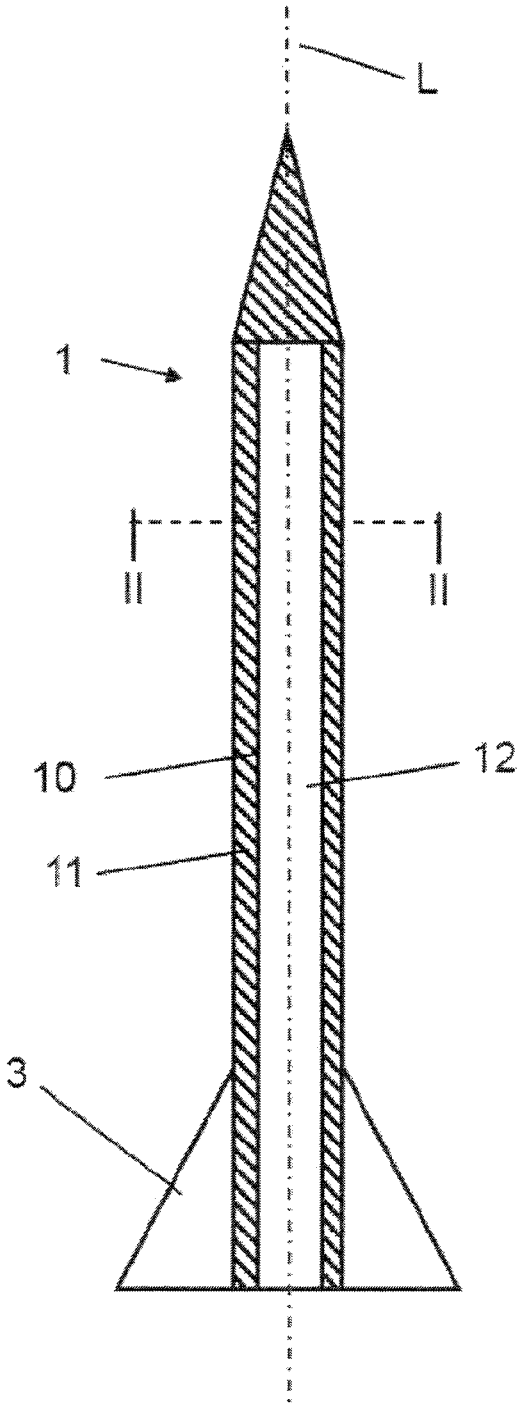
FIG. 3 shows a schematic sectional representation of an outer body of a penetrator according to the invention in accordance with a first exemplary embodiment.

FIG. 3 shows a schematic sectional representation of an outer body 13 of a penetrator 10 according to the invention in accordance with a first exemplary embodiment.

The penetrator 10 is designed for a projectile 1 with a tail assembly 3. Such a projectile 1 is shown in FIG. 3. The penetrator 10 has at least one outer body 11 that acts in a terminal ballistic manner for attacking an armored target, in particular a tank with reactive armor.

The cross-section of the outer body 11 perpendicular to a longitudinal axis L of the outer body 11 is a hollow cross-section.

Figure 4:
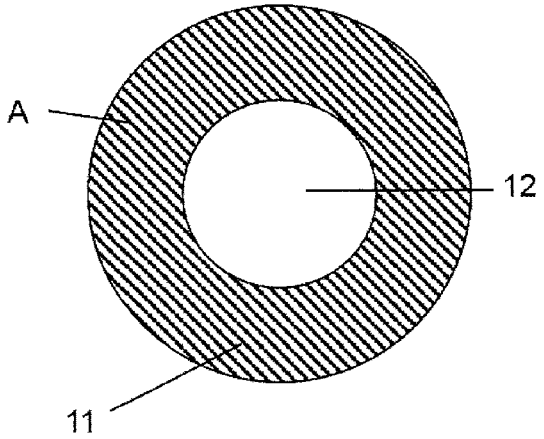
FIG. 4 shows a schematic sectional representation of the hollow cross-section of the outer body according to FIG. 3 along the line II-II.

This cross-section of the outer body 11 is shown along the line II-II in FIG. 4.

The hollow cross-section of the outer body 11 has an area A, and an area moment of inertia of the hollow cross-section is increased in comparison with a solid cross-section of at least equal area. The outer body 11 therefore has an increased bending stiffness on account of the increased area moment of inertia.

According to FIG. 4, the hollow cross-section of the outer body 11 is annular in design. However, a trapezoidal or a polygonal hollow cross-section is also possible.

The bending stiffness of the outer body of the penetrator according to the invention depends essentially on two parameters, namely the area moment of inertia and the modulus of elasticity.

For this purpose, the outer body 11 of the penetrator 1 has an area moment of inertia of more than 20,000 $mm^4$, preferably more than 40,000 $mm^4$, further preferably more than 60,000 $mm^4$, in particular more than 80,000 $mm^4$, and the modulus of elasticity is greater than 300,000 $N/mm^2$.

A tungsten heavy metal preferably is used as the material for the outer body 11 of the penetrator 1.

Preferably, the hollow cross-section extends over at least 70% of the length of the outer body 11 of the penetrator 1. According to FIG. 4, the hollow cross-section is arranged over the entire cylindrical—or nearly cylindrical—region of the outer body 11.

Figure 5:
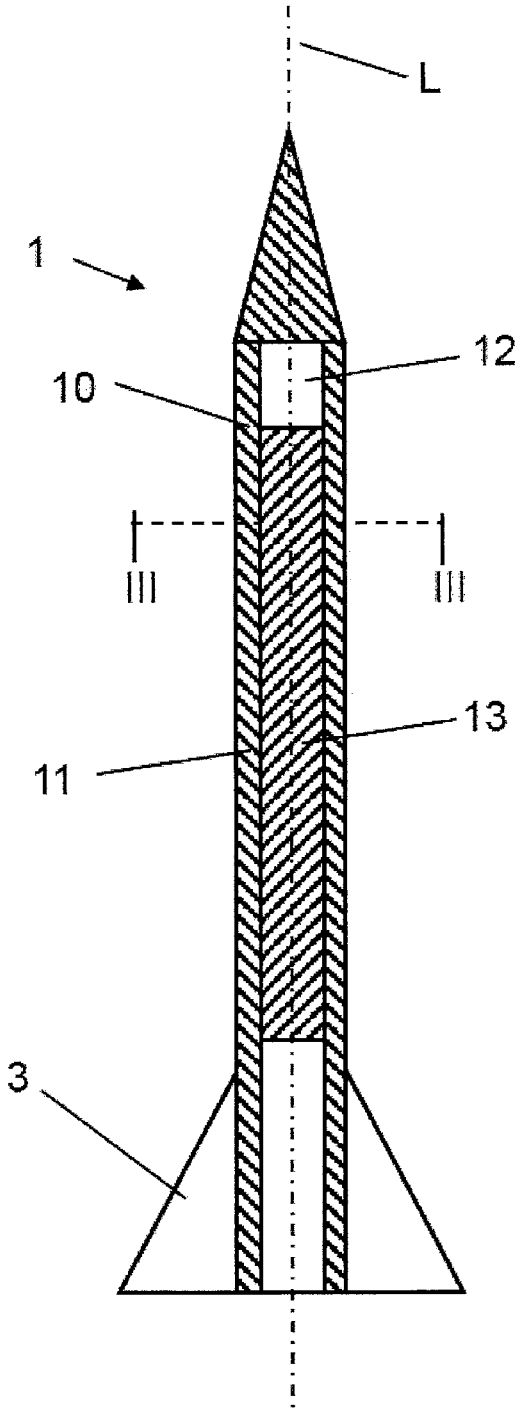
FIG. 5 shows a schematic sectional representation of an outer body and a core of a penetrator according to the invention in accordance with a second exemplary embodiment.
Figure 6:
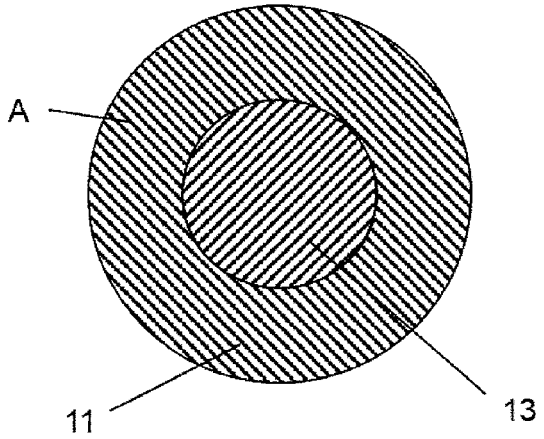
FIG. 6 shows a schematic sectional representation of the penetrator according to FIG. 5 along the line III-III.

FIG. 5 shows a schematic sectional representation of an outer body 11 and a core 13 of a penetrator 1 according to the invention in accordance with a second embodiment. The second embodiment is based on the first embodiment and differs therefrom in that a core 13 is arranged in the outer body 11 of the penetrator 1. FIG. 6 shows a schematic sectional representation of the penetrator 1 according to FIG. 5 along the line III-III.

The penetrator 10 has, arranged in the outer body 11, a core 13 that acts in a terminal ballistic manner. The core 13 has an effect that makes the outer body 11 more resistant to bending.

In order for both the outer body 11 and the core to act together in a terminal ballistic manner, they are joined to one another in an interlocking and/or frictional and/or integral manner.

The core 13 is made, for example, from a high-strength material, in particular a tungsten heavy metal sintered material or a high-strength steel.

The density of the outer body 11 is higher than the density of the core 13. The ratio of the density of the outer body 11 to the density of the core 13 preferably is less than 2.7.

The core 13 has a lower density than the outer body 11.

In addition, the core 13 has a modulus of elasticity of more than 70,000 $N/mm^2$, preferably of more than 170,000 $N/mm^2$, preferably of more than 200,000 $N/mm^2$, in particular of more than 300,000 $N/mm^2$.

According to FIG. 5, the core 13 extends over only a part of the length of the cavity 12 within the outer body 11. Position of the center of gravity of the penetrator 10 in relation its longitudinal axis L can be adjusted by positioning the core 13 within the outer body 11. This occurs owing to the position of the core 13 within the outer body 11 on the one hand, and owing to its mass on the other hand.

However, it is also possible that the core 13 fills the entire cavity 12 of the outer body 11.

The mass of the penetrator 10 is below 7 kg, preferably less than 6 kg. The mass of a penetrator 10 can be adjusted through the mass of the core 13, without the need to adapt the outer body 11.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A penetrator for a projectile with a tail assembly, the penetrator comprising:

at least one outer body that acts in a terminal ballistic manner for attacking an armored target, wherein the at least one outer body has a hollow cross-section perpendicular to a longitudinal axis of the at least one outer body, the hollow cross-section extending over at least a part of a length of the outer body to form a cavity within the at least one outer body, wherein the penetrator has a core that acts in a terminal ballistic manner, the core being arranged in the cavity within the at least one outer body, wherein the core extends only over a part of a length of the cavity, and wherein a position of a center of gravity of the penetrator, in relation to the longitudinal axis, is adjusted through adjusting a position of the core within the cavity of the at least one outer body.

2. The penetrator according to claim 1, wherein the at least one outer body is made of a tungsten heavy metal and has an area moment of inertia of more than 20,000 mm4, more than 40,000 mm4, more than 60,000 mm4, or more than 80,000 mm4, and a modulus of elasticity that is greater than 300,000 N/mm2.

3. The penetrator according to claim 1, wherein the hollow cross-section extends over at least 70% of a length of the at least one outer body.

4. The penetrator according to claim 1, wherein the core has a lower density than the at least one outer body.

5. The penetrator according to claim 4, wherein a mass of the penetrator is below 7 kg or less than 6 kg, the mass of the penetrator being adjustable by adjusting a mass of the core, the mass of the core being adjustable by adjusting a size or a material of the core.

6. The penetrator according to claim 4, wherein the position of the center of gravity of the penetrator, in relation to the longitudinal axis, is also adjusted through adjusting a mass of the core, the mass of the core being adjustable by adjusting a size or a material of the core.

7. The penetrator according to claim 1, wherein the hollow cross-section of the at least one outer body has an annular, trapezoidal, or polygonal shape.

8. The penetrator according to claim 1, wherein the core is made from a high-strength material.

9. The penetrator according to claim 1, wherein the at least one outer body and the core are made such that there is no fragmentation effect or only a negligible fragmentation effect upon impact with the armored target.

10. The penetrator according to claim 8, wherein the core has a modulus of elasticity of more than 70,000 N/mm2, more than 170,000 N/mm2, more than 200,000 N/mm2, or more than 300,000 N/mm2.

11. The penetrator according to claim 1, wherein the core has an effect that makes the at least one outer body more resistant to bending.

12. The penetrator according to claim 1, wherein the armored target is a battle tank with reactive armor.

13. A projectile comprising a sabot, a penetrator and a tail assembly, wherein the penetrator includes at least one outer body that acts in a terminal ballistic manner for attacking an armored target, and wherein the at least one outer body has a hollow cross-section perpendicular to a longitudinal axis of the at least one outer body.

14. The penetrator according to claim 8, wherein the high-strength material is a tungsten heavy sintered metal material or a high-strength steel.

* * * * *